United States Patent [19]

Sandt et al.

[11] 4,137,588

[45] Feb. 6, 1979

[54] PORTABLE CLEANING DEVICE

[76] Inventors: Clayton C. Sandt, P.O. Box 243, Mt. Pocono, Pa. 18344; Ira L. Kulp, 205 Elwyn Ave., Sinking Spring, Pa. 19608

[21] Appl. No.: 792,548

[22] Filed: May 2, 1977

Related U.S. Application Data

[63] Continuation-in-part of Ser. No. 620,166, Oct. 6, 1975, abandoned.

[51] Int. Cl.[2] ..... A46B 13/02

[52] U.S. Cl. ..... 15/22 R; 15/23; 15/28; 15/97 R

[58] Field of Search ..... 15/22 R, 23, 24, 28, 15/29, 97 R; 320/2

[56] References Cited

U.S. PATENT DOCUMENTS

| | | | |
|---|---|---|---|
| 1,969,549 | 8/1934 | Eppstein | 15/23 |
| 3,183,538 | 5/1965 | Hubner | 15/23 X |
| 3,240,966 | 3/1966 | Thompson | 15/28 X |
| 3,255,637 | 6/1966 | Boyles | 15/22 R X |
| 3,274,631 | 9/1966 | Spohr | 15/22 R |
| 3,277,358 | 10/1966 | Nicholl | 15/22 R X |
| 3,585,669 | 6/1971 | Moret et al. | 15/22 R |

FOREIGN PATENT DOCUMENTS

| | | | |
|---|---|---|---|
| 363635 | 9/1962 | Switzerland | 15/22 R |
| 468806 | 2/1969 | Switzerland | 15/22 R |

*Primary Examiner*—Christopher R. Moore
*Attorney, Agent, or Firm*—Robert D. Farkas

[57] ABSTRACT

This disclosure pertains to a portable rechargeable battery operated handheld cleaning device adapted to receive various cleaning implements, such as wire brushes, abrasive wheels, and the like into one of the dual internally housed transverse cleaning implement receiving tongues. Each tongue, used singly at the option of the user, has a reciprocating motion limited to one hundred eighty degrees. Terminals are provided for recharging the batteries included in the waterproof fully immersible housing. A charging device, operating from household voltage, provides the requisite battery charging current when the handheld cleaning device is connected to it. The charging device is energized by the household current only when the handheld cleaning device is inserted into it, so as to close a charging enabling switch internally mounted within the charging device.

6 Claims, 14 Drawing Figures

PORTABLE CLEANING DEVICE

This is a Continuation-in-part of application Ser. No. 620,166, filed Oct. 6, 1975, and now abandoned.

BACKGROUND OF THE INVENTION

1. The Field of the Invention

This invention relates to portable handheld cleaning devices in the class operated by electrical motors.

2. Description of the Prior Art

The prior art abounds with cleaning devices, battery or line cord operated, which continuously rotate the work or cleaning tool. Oscillating or reciprocating implements have been employed in portable battery operated tooth brushes, with or without associated charging equipment.

SUMMARY OF THE INVENTION

A household current operated battery charging device energized only during the time periods that a portable handheld waterproof cleaning apparatus is in charging engagement therewith. The waterproof housing of the hand-held cleaning apparatus has within it compartments containing electrical terminals, a rechargeable battery, an electrical motor, an on-off operating switch, a speed reducing gear train, and a device to provide reciprocating motion limited to one hundred eighty degrees of rotation to two transverse cleaning implement receiving tongues.

A primary object of the instant invention is to provide a handheld cleaning apparatus capable of operating detachable cleaning implements in either of two locations, transverse to each other.

Another object is to provide a handheld cleaning apparatus operated by internally mounted rechargeable batteries.

Still another object is to provide a handheld cleaning apparatus which is completely immersible in water.

A further object is to provide a reciprocating motion to the shafts of cleaning implements utilized.

Another object is to provide a recharging unit which consumes energy only when the batteries are being recharged.

Still another object is to provide a secure means for rapidly attaching and detaching accessory cleaning implements.

These objects, as well as other objects, of this invention will become readily apparent after reading the following description of the accompanying drawings.

DESCRIPTION OF THE PREFERRED EMBODIMENT

A portable rechargeable battery operated motor, encased within a waterproof fully immersible housing, drives a speed reducing gear box. The reduced rotary speed output shaft of the gear box drives a device which provides reciprocating oscillatory motion to each of the dual internally housed cleaning implement receiving tongues. The cleaning implement receiving tongues are mounted at right angles to each other having their free ends at openings in the housing. One receiving tongue is parallel to the longitudinal axis of the handheld apparatus, facilitating the versatility of operation in various cleaning applications. The other cleaning implement receiving tongue is transverse to the first tongue and similarly provides enhanced flexibility in the use of the apparatus in a variety of cleaning tasks.

A line cord provides energy to the battery charging apparatus when the portable cleaning device is inserted into a cavity adapted with output terminals and an enabling switch, utilized to energize the battery charging device only when the handheld tool is so engaged. Line power consumption is limited to those time periods in which the handheld apparatus is in charging engagement with the recharging device.

A variety of detachable cleaning implements are adapted to selectively interchangeably engage with each of the tongues utilizing a coaxial snap-on tongue engaging end.

Figure 1:
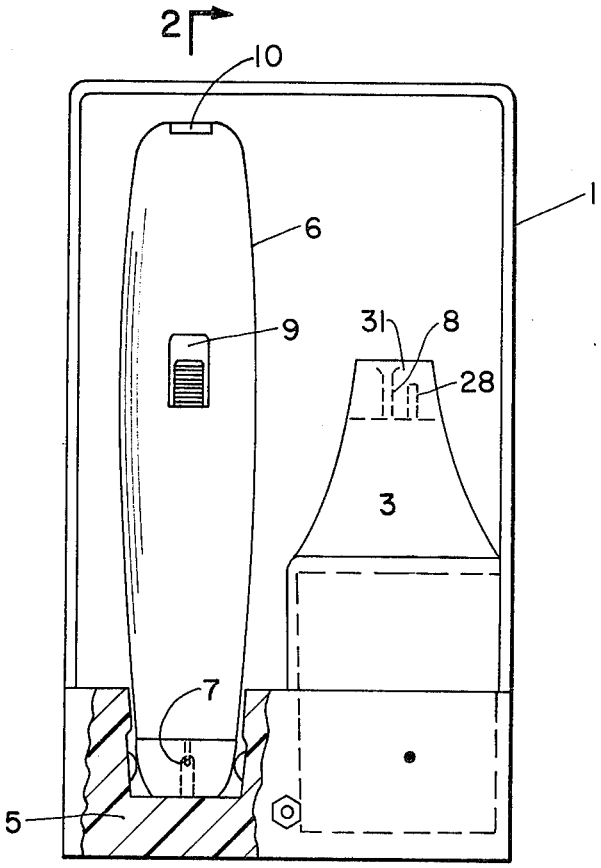
FIG. 1 is a front elevation view of a wall mounted storage case in which a handheld cleaning apparatus and battery charging device are stored.

Now referring to the Figures, and more particularly to the embodiment illustrated in FIG. 1 showing the wall mounted storage case 1 having a battery recharging apparatus 3 mounted within. A cavity in a base element 5 accepts a portion of the portable handheld cleaning apparatus 6. Electrical terminals 7, shown in phantom, can be connected to mating electrical terminals 8, shown in phantom, within the battery recharging apparatus 3. Shaft 28, shown in phantom, is depressed when the lowermost end of the portable handheld cleaning apparatus 6 is inserted into cavity 31. When shaft 28 is depressed, an internal switch, not shown, is closed which permits electrical energy supplied by household current to flow into the input of the electrical circuitry, well known to the art, used to provide the charging current available at terminals 8. Only when the lowermost portion of the portable handheld cleaning apparatus 6 is engaged in cavity 31 will household current be consumed by the battery recharging apparatus 3 and recharging current made available at output terminals 8. An on-off operating switch 9 controls the periods of time in which the portable handheld cleaning apparatus 6 has its internal motor, not shown, in operation. An opening 10, circular in shape, permits the entrance of auxiliary cleaning implements.

Figure 2:
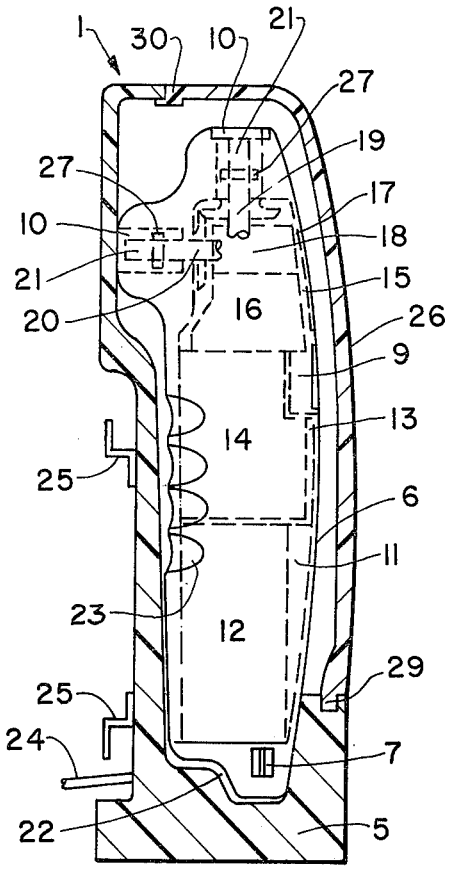
FIG. 2 is a cross-sectional view taken along line 2—2 viewed in the direction of arrows 2—2 as shown in FIG. 1 illustrating a cross-section of the storage case and the handheld cleaning apparatus.

FIG. 2 is a side elevation cross-sectional view of the wall mounted storage 1 and the portable handheld cleaning apparatus 6. A waterproof housing 22 contains a plurality of compartments. Compartment 11 contains rechargeable batteries 12 which are electrically connected to the charging terminals 7. Compartment 13 contains motor 14 and provides a cavity in which the on-off operating switch 9 can be mounted. Compartment 15 houses a conventional gear train 16 having its input shaft coaxially coupled with the output shaft of motor 14. Conpartment 17 contains a cam mechanism 18, well known to the art, which has output shafts 19 and 20 that are driven in reciprocally oscillatory motion limited to one hundred eighty degree rotation. Cleaning implement receiving tongues 21 fasten to shafts 19 and 20, having their free ends pass through circular openings 10 in the waterproof housing 22. Finger gripping undulations 23 facilitate convenient secure handling of the portable handheld cleaning apparatus 6 when in use. Line cord 24 provides household current to the battery recharging apparatus, net shown. Mounting clips 25 facilitate the fastening of the storage case 1 to a wall or other vertical surface. A transparent front cover 26 can be removed by disengagement at edges 29 and 30. Alternatively, a pivotal joint may be provided at the edge numbered 29 thus allowing the front cover to swing forward in a downward direction. Pins 27, transverse to the axis of shafts 19 and 20, are used to engage an accommodating hole machined into the vertical slot to be found at the ends of the cleaning implements, adapted to fasten to the cleaning implement receiving tongues 21.

Figure 3:
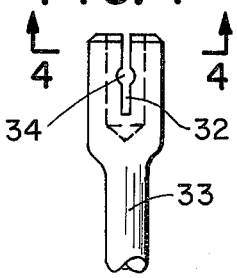
FIG. 3 is a partial side elevation view typically found at the end of associated cleaning implements.

FIG. 3 illustrates a typical shaft end of a cleaning implement which is adapted to securely fasten to the cleaning implement receiving tongues 21 illustrated in FIG. 2. The flat portion of cleaning implement receiving tongues 21 fit within slot 32 which is machined parallel to and coincident with the longitudinal axis of the shaft 33. A hole 34 is at right angles to the longitudinal axis of the shaft 33 and is drilled into the plane of slot 32 midway along its length.

Figure 4:
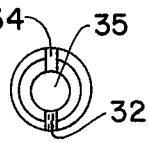
FIG. 4 is a cross-sectional view taken along line 4—4 viewed in the direction of arrows 4—4 as shown in FIG. 3 illustrating the free end of associated cleaning implements.

FIG. 4 illustrates the hole 34 designed to accommodate transverse pins 27 into snapping engagement. Coaxial longitudinal hole 35 provides a predetermined amount of springability to the structure at the left and right-hand sides of the slot 32, thus providing a snapping-in effect when the cleaning implement is engaged with tongues 21 and transverse pins 27 as shown in FIG. 2.

Figure 5:
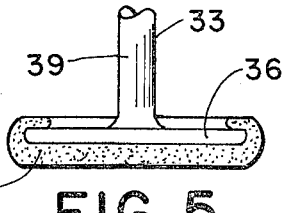
FIG. 5 is a partial cross-sectional view of the front elevation of an abrasive surfaced cleaning implement.

FIG. 5 illustrates a cross-sectional view of the accessory cleaning implement 39 having a shaft 33 fastened transversely to a circular metallic plate 36. An abrasive material, such as fused silica 37, encases circular metallic plate 36 and is utilized for a variety of cleaning purposes.

Figure 6:
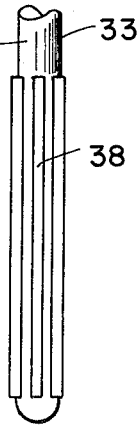

FIG. 6 illustrates the utility end of the cleaning implement 40 adapted with a surface which has longitudinal grooves 38 machined therein permitting the implement to be used in heavy cleaning applications within holes and the like.

Figure 7:
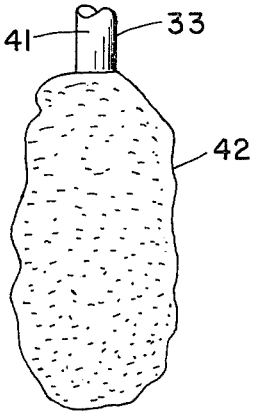

FIG. 7 is the cleaning implement 41 utilizing steel wool 42 fastened to the utility end of shaft 33.

Figure 8:
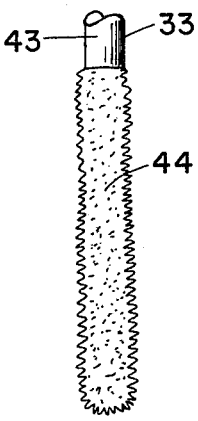
FIGS. 6, 7, 8, 9, and 10 are partial front elevation views of various cleaning implements.

FIG. 8 is the cleaning implement 43 adapted with a plurality of horizontal steel wires 44 which are bristle-like in nature, attached to a portion of the length of shaft 33 including the free end thereof.

Figure 9:
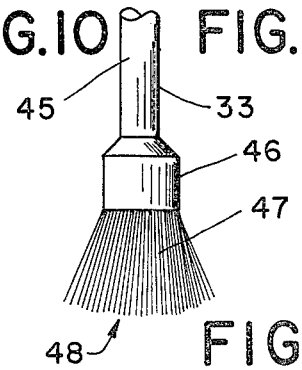

FIG. 9 is the cleaning implement 45 having a hub structure 46, from which emerges a plurality of wire elements 47 radiating from the opening of hub 46 to provide a planar cleaning surface 48 comprised of the ends of the wires 47

Figure 10:
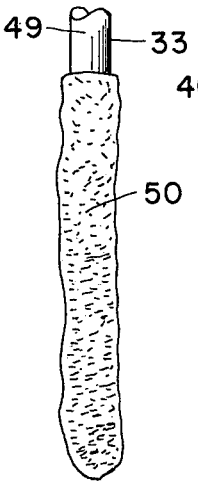

FIG. 10 is the cleaning implement 49 having its free end covered with a fabric-like sleeve 50 used to polish, buff, or clean holes or broad surfaces.

Figure 11:
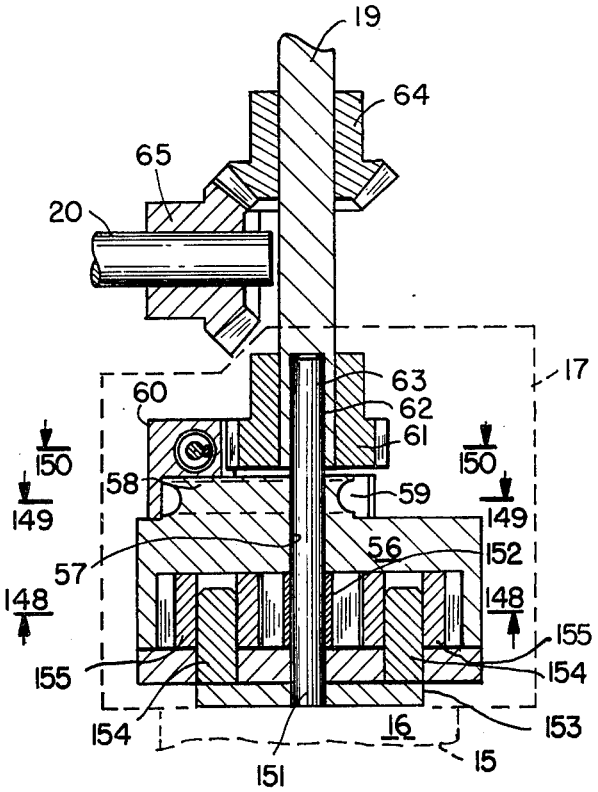
FIG. 11 is a partial side elevation cross-sectional view of the apparatus shown in FIG. 2.

FIG. 11 illustrates a portion of compartment 15 housing gear train 16 therein. Compartment 17 includes shaft 151 eminating from compartment 15, representing an output shaft on the low speed side of gear train 16 contained within compartment 15. When motor 14 is energized, shaft 151 rotates in a given direction. Gear 152 is fixedly secured to shaft 151 and is co-axially aligned with the shaft. Thus, when shaft 151 rotates, gear 152 rotates therewith. Plate 153 is attached to compartment 15 and does not rotate when gear 152 is caused to rotate. Rods 154 provide a bearing surface about which gears 155 are free to rotate. Gears 155 are meshed with gear 152. Gear gousing block 56 contains hole 57 through which shaft 151 passes. Hole 57 is loosely fit on shaft 151, thus allowing housing 56 to rotate at a speed independent of the speed of rotation of shaft 151. Housing 56 is causes to rotate when gears 155 engage internal teeth, not shown, located on the interior surface of housing 56. Eccentric cam 58 is fixed to and forms a part of housing 56. Semi-circular groove 59 is formed in the exterior side wall of cam 58. A ball, not shown, engages groove 59 and a rack supporting housing 60. As cam 58 rotates, the rack supporting housing 60 remains stationary but a rack, not shown, engages gear 61 causing the gear to reciprocate 180° as the rack is moved reciprocally. Gear 61 is fixedly secured to shaft 19. Shaft 19 is free to oscillate independently from shaft 151 because hole 62 is a loosed fit accommodating end 63 of shaft 151. Bevel gear 64 is secured to shaft 19 and oscillates in accordance therewith. Bevel gear 65 meshes with bevel gear 64 and oscillates in reverse directions to the oscillations of gear 64. Gear 65 is co-axially aligned with and secured to shaft 20. Thus, shafts 19 and 20 oscillate 180°, in opposite directions, due to the rotational movement in one direction, imparted to shaft 151 by gear train 16, not shown.

Figure 12:
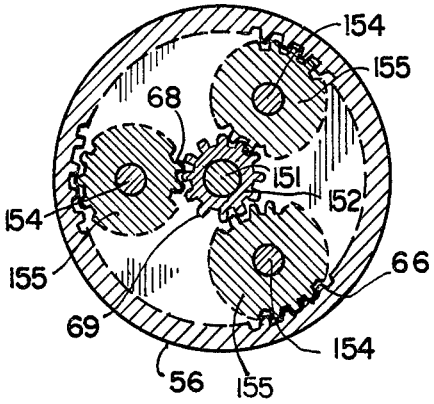
FIG. 12 is a cross-sectional view taken through lines 148—148, as viewed in the direction of arrows 148—148, shown in FIG. 11.

FIG. 12 shows housing 56 in cross-sectional view having internal teeth 66 engaging the teeth on the lowermost gear 155. Rods 154 are shown rotationally supporting gears 155. Teeth 68, disposed on the surface of leftmost gear 155 engage teeth 69 disposed on the surface of the driving gear 152. Shaft 151 is shown passing through gear 152.

Figure 13:
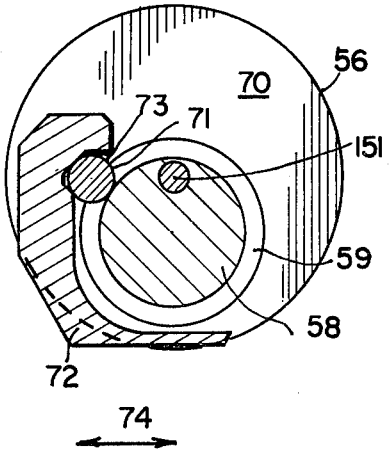
FIG. 13 is a cross-sectional view taken through lines 149—149, as viewed in the direction of arrows 149—149, shown in FIG. 11.

FIG. 13 illustrates surface 70 of housing 56 on which cam 58 is secured. Groove 57 is shown engaging ball 71. Arm 72 is provided with socket 73, utilized to secure portions of ball 71 therein. Arm 72 is free to move in the directions of arrows 74 dependent upon the rotational position taken by cam 58 when rotated by shaft 151.

Figure 14:
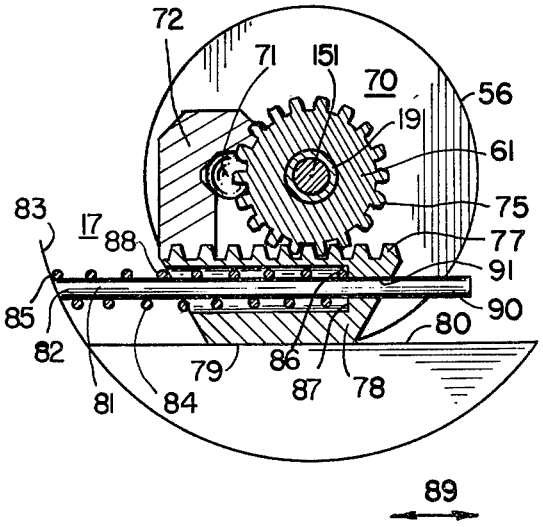
FIG. 14 is a cross-sectional view taken through lines 150—150, as viewed in the direction of arrows 150—150, as shown in FIG. 11.

FIG. 14 illustrates surface 70 of housing 56 and gear 61 co-axially aligned with shafts 19 and shafts 151. Ball 71 is shown engaged within arm 72. Rack 75 is shown secured to arm 72, having teeth 76 thereof engaged with teeth 77 of rack 75. Rack 75 is shown secured to block 78. Block 78 is prevented from rotation by having surface 79 thereof engage surface 80 formed in a portion of the wall defining compartment 17. Rod 81 is shown having end 82 thereof secured to wall 83, which defines the interior surface of compartment 17. Helical spring 84 extends along rod 81 so as to have end 85 of the spring in touching engagement with wall 83 and end 86 in touching engagement with wall 87, located at the bottom of hole 88. Hole 88 is formed in block 78. Spring 84 exerts a constant force, on block 78 in the direction of arrow 89. End 90 of rod 81 passes through a hole 91 which communicates with block 78. When ball 71 reciprocates back and forth in the direction of arrow 89 and oppositely thereto, rack 75 in turn reciprocates in the same direction causing gear 61 to oscillate 180°. Gear 61, being coupled to shaft 19, causes bevel gear 64, shown in FIG. 11, to also oscillate 180°.

One of the advantages is a handheld cleaning apparatus capable of operating detachable cleaning implements in either of two locations, transverse to each other.

A further advantage is a handheld cleaning apparatus operated by internally mounted rechargeable batteries.

Another advantage is a handheld cleaning apparatus which is completely immersible in water.

Still another advantage is a reciprocating motion to the shafts of cleaning implements utilized.

A further advantage is a recharging unit which consumes energy only when the batteries are being recharged.

Another advantage is a secure means for rapidly attaching and detaching accessory cleaning implements.

Thus, there is disclosed in the above description and in the drawings, an embodiment of the invention which fully and effectively accomplishes the objects thereof. However, it will be apparent, to those skilled in the art, how to make variations and modifications to the instant invention. Therefore, this invention is to be limited not by the specific disclosure herein, but only by the appending claims.

The embodiments of the invention in which an exclusive privilege or property is claimed are defined as follows:

I claim:

1. A portable cleaning device comprising a waterproof housing with openings providing access to enclosed first electrical engaging terminals, on-off operating switch, first cleaning implement receiving tongue and second cleaning implement receiving tongue, the opening nearest said terminals comprises a slot in said housing, said first electrical engaging terminals connected to rechargeable batteries contained within said waterproof housing, said rechargeable batteries providing electrical energy to an electric motor contained within said housing when said operating switch is closed, an output of said electric motor adapted to rotatably attach to a gear train contained within said housing, said gear train rotatably connected to cam means providing alternating reciprocating motion limited to one hundred eighty degree rotation to first and second shafts, the axes of said first and second shafts being located at right angles to each other lying in a plane, the longitudinal axis of said housing lying in said plane and coincident with the axis of said first shaft, said first cleaning implement receiving tongue being fastened to said first shaft, said second cleaning implement receiving tongue being fastened to said second shaft.

2. The portable cleaning device of claim 1 in combination with an enclosure comprising rechargeable battery charging means adapted to be operated from household voltage, a cavity in said enclosure adapted to receive the immediate surrounding structure of said housing adjacent said slot, a line cord adapted to supply input power to said rechargeable battery charging means in series with a power supply energizing control switch, said power supply energizing control switch being in closed position upon engagement or location of said immediate surrounding structure of said housing into said cavity and being in open position when said immediate surrounding structure of said housing is disengaged from said cavity, said rechargeable battery charging means adapted to provide suitable charging voltage for said rechargeable battery to second electrical engaging terminals in said cavity, said first and second engaging terminals being electrically connected to each other when said immediate surrounding structure of said housing is placed within said cavity.

3. The portable cleaning device of claim 2 further comprising said enclosure having a portable cleaning device supporting cavity formed therein, said supporting cavity adapted to receive the portion of said housing structure immediately surrounding said slot, said supporting cavity confined within said enclosure, means to fasten said enclosure to a vertical surface.

4. The portable cleaning device of claim 1 in combination with a cleaning implement comprising a shaft having one free end, said free end adapted to securely engage either said first tongue or said second tongue, said cleaning implement shaft being coaxial with said first shaft when said cleaning implement free end is in engagement with said first cleaning implement recieving tongue, said cleaning implement shaft being coaxial with said second shaft when said cleaning implement free end is in engagement with said second cleaning implement receiving tongue, means to disengage said cleaning implement from said first or said second cleaning implement receiving tongues located on said one free end of said cleaning implement.

5. The portable cleaning device of claim 4 further comprising the other end of said cleaning implement shaft having surface abrading means affixed thereto.

6. The portable cleaning device of claim 1 further comprising a plurality of finger gripping undulations formed within the surface of said housing.

* * * * *